US011111726B2

(12) United States Patent
Batarseh

(10) Patent No.: US 11,111,726 B2
(45) Date of Patent: Sep. 7, 2021

(54) LASER TOOL CONFIGURED FOR DOWNHOLE BEAM GENERATION

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 72 days.

(21) Appl. No.: 16/056,669

(22) Filed: Aug. 7, 2018

(65) Prior Publication Data

US 2020/0048966 A1 Feb. 13, 2020

(51) Int. Cl.

| | |
|---|---|
| ***E21B 7/15*** | (2006.01) |
| ***E21B 43/11*** | (2006.01) |
| ***E21B 47/07*** | (2012.01) |
| ***E21B 21/16*** | (2006.01) |
| ***E21B 47/00*** | (2012.01) |
| ***E21B 47/06*** | (2012.01) |

(52) U.S. Cl.

CPC ..... *E21B 7/15* (2013.01); *E21B 21/16* (2013.01); *E21B 43/11* (2013.01); *E21B 47/00* (2013.01); *E21B 47/06* (2013.01); *E21B 47/07* (2020.05)

(58) Field of Classification Search

CPC ..... E21B 7/15; E21B 43/11

See application file for complete search history.

(56) References Cited

U.S. PATENT DOCUMENTS

| | | | | |
|---|---|---|---|---|
| 3,871,485 A | | 3/1975 | Keenan, Jr. | |
| 4,113,036 A | * | 9/1978 | Stout | E21B 7/15 166/248 |
| 4,199,034 A | * | 4/1980 | Salisbury | E21B 7/15 166/308.1 |
| 4,282,940 A | * | 8/1981 | Salisbury | B26F 1/31 175/11 |
| 6,755,262 B2 | | 6/2004 | Parker | |
| 7,490,664 B2 | * | 2/2009 | Skinner | E21B 7/15 166/57 |

(Continued)

FOREIGN PATENT DOCUMENTS

| | | |
|---|---|---|
| CN | 203081295 U | 7/2013 |
| CN | 203334954 U | 12/2013 |

(Continued)

OTHER PUBLICATIONS

International Search Report for PCT/IB2018/057645, 5 pages (dated Apr. 15, 2019).

(Continued)

*Primary Examiner* — Jennifer H Gay

(74) *Attorney, Agent, or Firm* — Choate, Hall & Stewart LLP; Charles E. Lyon; Peter A. Flynn

(57) ABSTRACT

An example laser tool configured for downhole laser beam generation is operable within a wellbore. The laser tool includes a generator to generate a laser beam. The generator is configured to fit within the wellbore, to withstand at least some environmental conditions within the wellbore, and to generate the laser beam from within the wellbore. The laser beam has an optical power of at least one kilowatt (1 kW). A control system is configured to control movement of at least part of the laser tool to cause the laser beam to move within the wellbore.

12 Claims, 4 Drawing Sheets

(56) References Cited

U.S. PATENT DOCUMENTS 7,938,175 B2 * 5/2011 Skinner ..... E21B 7/15 166/57
8,464,794 B2 * 6/2013 Schultz ..... E21B 29/02 166/297
8,627,901 B1 1/2014 Underwood et al.
9,085,050 B1 * 7/2015 Zediker ..... B23K 26/146
9,217,291 B2 12/2015 Batarseh
9,353,612 B2 5/2016 Batarseh
9,932,803 B2 4/2018 Batarseh et al.
10,385,668 B2 * 8/2019 Batarseh ..... E21B 43/2405
10,415,338 B2 * 9/2019 Batarseh ..... G02B 27/0955
2004/0195003 A1 10/2004 Batarseh
2004/0206505 A1 * 10/2004 Batarseh ..... E21B 43/11 166/302
2006/0102343 A1 * 5/2006 Skinner ..... E21B 7/15 166/250.1
2006/0231257 A1 * 10/2006 Reed ..... B28D 1/00 166/297
2009/0133871 A1 * 5/2009 Skinner ..... E21B 7/15 166/250.16
2010/0007841 A1 1/2010 Baek et al.
2010/0326659 A1 * 12/2010 Schultz ..... E21B 29/02 166/297
2012/0118568 A1 * 5/2012 Kleefisch ..... E21B 43/11 166/297
2013/0228372 A1 * 9/2013 Linyaev ..... E21B 7/15 175/16
2014/0182933 A1 * 7/2014 Skinner ..... E21B 43/11 175/16
2014/0231147 A1 * 8/2014 Bozso ..... E21B 7/061 175/73
2014/0360778 A1 * 12/2014 Batarseh ..... E21B 7/14 175/17
2016/0160618 A1 * 6/2016 Batarseh ..... E21B 43/114 175/16
2016/0251940 A1 * 9/2016 De Witt ..... B23K 26/146 166/304
2016/0273325 A1 * 9/2016 Montaron ..... E21B 43/26
2017/0191314 A1 * 7/2017 Faircloth ..... E21B 7/14
2018/0163524 A1 * 6/2018 Batarseh ..... E21B 43/26
2019/0032434 A1 * 1/2019 Batarseh ..... G02B 27/0994
2019/0040726 A1 * 2/2019 Deutch ..... E21B 43/119
2019/0257156 A1 * 8/2019 Batarseh ..... H01S 3/0071
2019/0345812 A1 * 11/2019 Aljubran ..... G01V 8/00
2019/0353032 A1 * 11/2019 Batarseh ..... E21B 43/11
2020/0048966 A1 * 2/2020 Batarseh ..... E21B 47/06
2020/0048967 A1 * 2/2020 Batarseh ..... E21B 7/15

FOREIGN PATENT DOCUMENTS

GB 2 420 135 A 5/2006
WO WO-2015089458 A1 * 6/2015 ..... E21B 29/06

OTHER PUBLICATIONS

Written Opinion for PCT/IB2018/057645, 7 pages (dated Apr. 15, 2019).

* cited by examiner

LASER TOOL CONFIGURED FOR DOWNHOLE BEAM GENERATION

TECHNICAL FIELD

This specification describes examples of laser tools configured to generate a laser beam downhole and to output the laser beam downhole.

BACKGROUND

A laser tool may be used to output a laser beam within a wellbore. The laser beam may be used in a number of applications, including wellbore stimulation. However, optical power loss can limit the effectiveness of the laser beam. For example, an optical transmission medium such as fiber optics may transmit the laser beam from a generator at the surface to the laser tool downhole. As the laser beam travels along the optical transmission medium, the optical power of the laser beam decreases. The resulting optical power loss increases as the distance the laser beam travels increases. In some downhole applications, the optical power loss may be considerable. This optical power loss may adversely affect use of the laser beam downhole. Also, in some cases, transmission of the laser beam may heat the optical transmission medium. This can cause damage downhole—for example, the medium and other downhole components may burn—thereby affecting operation of components within the wellbore.

SUMMARY

An example laser tool is configured for downhole laser beam generation. The laser tool is operable within a wellbore. The laser tool includes a generator to generate a laser beam. The generator is configured to fit within the wellbore, to withstand at least some environmental conditions within the wellbore, and to generate the laser beam from within the wellbore. The laser beam has an optical power of at least one kilowatt (1 kW). A control system is configured to control movement of at least part of the laser tool to cause the laser beam to move within the wellbore. The laser tool may include one or more of the following features, either alone or in combination.

The generator may include a head to output the laser beam. The generator may be or include a direct diode laser. The generator may be configured to withstand environmental conditions that include at least one of temperature, pressure, vibrations, or composition of material within the wellbore.

The control system may be configured to rotate the head about a pivot point to produce a circular pattern at a bottom of the wellbore.

The laser tool may include an optical assembly configured to fit within the wellbore, to receive the laser beam from within the wellbore, and to output the laser beam towards a target. The optical assembly may be rotatable within the wellbore. Rotation of the optical assembly may be around a longitudinal axis of the wellbore. The optical assembly also may be movable along the longitudinal axis of the wellbore.

The optical assembly may include a reflector to change a direction of the laser beam and one or more lenses to shape the laser beam prior to output. Shaping the laser beam may include focusing the laser beam. Shaping the laser beam may include collimating the laser beam. Shaping the laser beam may include spreading the laser beam. The one or more lenses may include an optical control lens to control at least one of a size or a shape of the laser beam and a cover lens to protect at least the control lens. The one or more lenses may include an orientation lens to change an orientation of the laser beam between a vertical orientation and a horizontal orientation. The cover lens may also protect the orientation lens.

The laser tool may include a purging knife inclined at an angle relative to the laser beam. The purging knife may be configured to output a purging media in a direction of the laser beam. The purging media may include an inert gas or a liquid.

An example method of producing a laser beam downhole includes lowering a laser generator downhole in a wellbore and using the laser generator to generate the laser beam downhole. The laser beam has an optical power of at least 1 kW. The method also includes directing the laser beam to an inner surface of the wellbore to cut through at least part of a structure from within the wellbore. The method may include one or more of the following features, either alone or in combination.

The laser generator may include a head to output the laser beam. The method may include rotating the head about a pivot point to produce a circular pattern at a bottom of the wellbore. The method may include lowering an optical assembly downhole in the wellbore along with the laser generator. The optical assembly may be for directing the laser beam. The method may include rotating the optical assembly within the wellbore. Rotation of the optical assembly within the wellbore may be around a longitudinal axis of the wellbore. The method may include translating the optical assembly along the longitudinal axis of the wellbore. The optical assembly may include a mirror to change a direction of the laser beam and one or more lenses to shape the laser beam prior to output.

Any two or more of the features described in this specification, including in this summary section, may be combined to form implementations not specifically described in this specification.

At least part of the systems and processes described in this specification may be controlled by executing, on one or more processing devices, instructions that are stored on one or more non-transitory machine-readable storage media. Examples of non-transitory machine-readable storage media include, but are not limited to, read-only memory, an optical disk drive, memory disk drive, and random access memory. At least part of the systems and processes described in this specification may be controlled using a computing system comprised of one or more processing devices and memory storing instructions that are executable by the one or more processing devices to perform various control operations.

The details of one or more implementations are set forth in the accompanying drawings and the description. Other features and advantages will be apparent from the description, the drawings, and the claims.

DESCRIPTION OF THE DRAWINGS

Like reference numerals in the figures indicate like elements.

DETAILED DESCRIPTION

Figure 1:
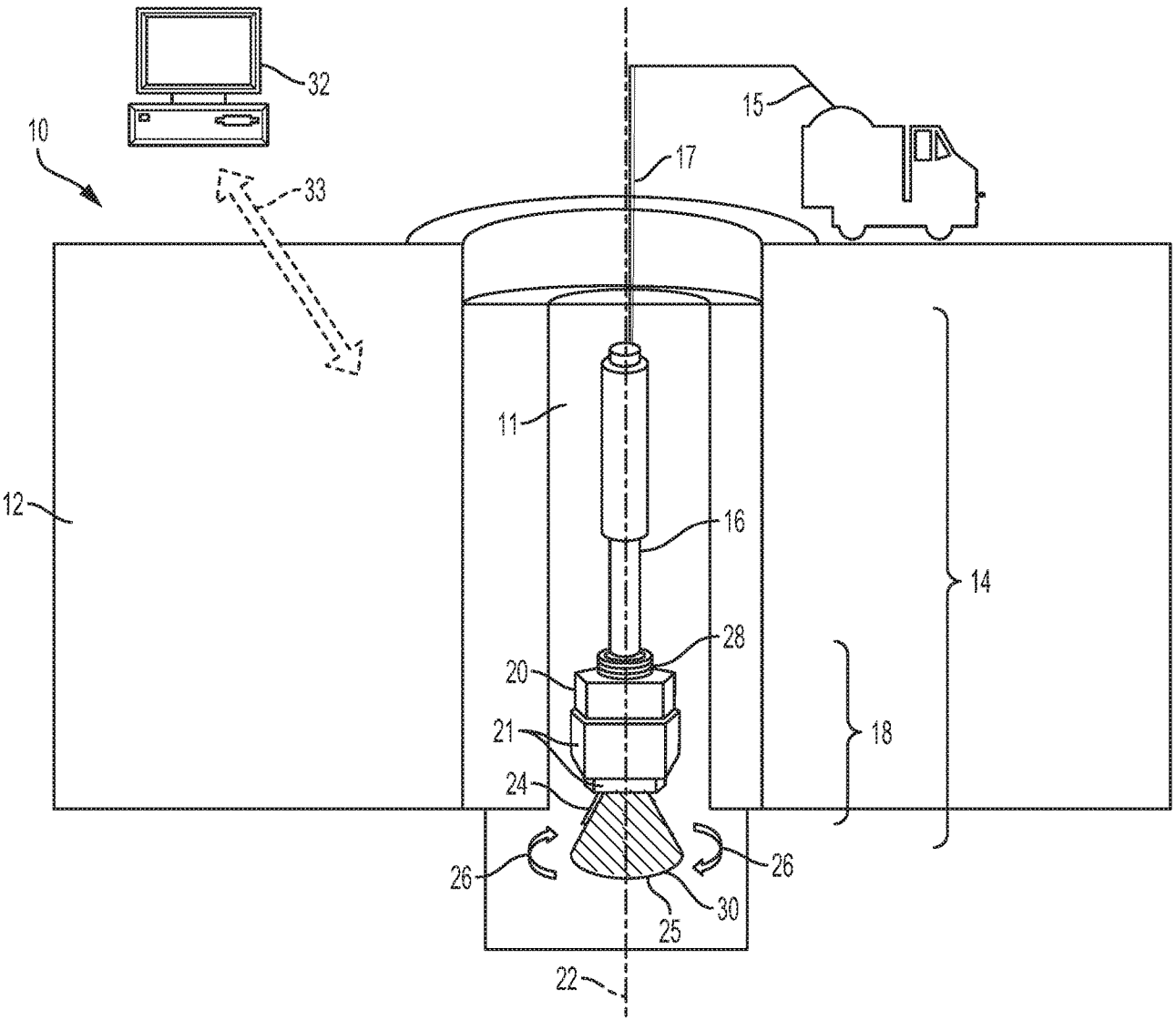
FIG. 1 is a block diagram of a system and a cross-sectional, side view of components an example laser tool downhole in a wellbore.

This specification describes examples of laser tools for ablating structures located downhole, such as rock formations, casing, and debris. An implementation of the laser tool includes a laser generator (or simply, "generator") to generate a laser beam. The generator is configured to fit within the wellbore, to withstand at least some environmental conditions within the wellbore, and to generate the laser beam from within the wellbore. The laser beam generated within the wellbore may be a high power laser beam. In some implementations, a laser beam may be classified as a high power laser beam if it has an optical power of one kilowatt (1 kW) or more.

A control system is configured to control movement of at least part of the laser tool to cause the laser beam to move within the wellbore. For example, the laser beam may be controlled to move circularly to target the bottom of the wellbore. For example, the laser beam may be controlled to rotate around a longitudinal axis of the wellbore in order to target a circumference of the wellbore. For example, the laser beam may be controlled to move along the longitudinal axis of the wellbore in order to target a linear segment of the wellbore. For example, the laser beam may be controlled both to rotate around the longitudinal axis and to move along the longitudinal axis in order to target a circumference of the wellbore that extends along the longitudinal axis. The laser tool may be configured to direct the laser beam parallel to a surface containing a wellhead or at an angle that is not parallel to the surface.

In some implementations, an optical assembly may receive the laser beam from a head of the generator. The optical assembly may include optics, such as mirrors, lenses, or both mirrors and lenses to direct the laser beam, to shape the laser beam, and to size the laser beam. In some implementations, the optical assembly receives the laser beam directly from the generator. For example, the laser beam does not pass through an optical transmission medium, such as fiber optic cable, on its path between the generator and the optical assembly. As a result, reductions in power loss caused by optical transmission media may be eliminated or reduced.

The example laser tool may also include one or more sensors to monitor environmental conditions in the wellbore and to output signals indicative of the environmental conditions. Examples of the sensors may include temperature sensors to measure temperature downhole, pressure sensors to measure pressure downhole, and vibration sensors to measure vibrations levels downhole. Other sensors may also be used, such as acoustic sensors. Signals received from the sensors may indicate that there are problems inside the wellbore or that there are problems with the laser tool. A drilling engineer may take corrective action based on these signals. For example, if a temperature or pressure downhole is such that equipment like the laser tool may be damaged, that equipment may be withdrawn from the wellbore.

FIG. 1 shows components of an example system 10 that includes an implementation of a laser tool of the type described in the preceding paragraphs. At least part of system 10 is located within wellbore 11. In this example, wellbore 11 passes through a hydrocarbon-bearing rock formation 12 ("rock formation 12"). Rock formation 12 may include various materials, such as limestone, shale, or sandstone.

Laser tool assembly 14 may be lowered downhole by a coiled tubing unit 15 or a wireline. In this example, laser tool assembly 14 includes cabling 17, a cable casing 16, and a laser tool 18. Laser tool 18 includes a laser generator ("generator") 20 that resides downhole during operation of the laser tool and that generates a laser beam from downhole. An example generator is a direct diode laser. Direct diode lasers include laser systems that use the output of laser diodes directly in an application. This is in contrast to other types of lasers in which the output of laser diodes is used to pump another laser to generate an output. Examples of direct diode lasers include systems that generate straight-line beam shapes and systems that generate circular beam shapes. A straight-line beam shape includes lasers that travel directly from one point to another. A straight-line beam shape also includes lasers having a diameter that stays the same or that changes during travel. A circular beam shape is generated by rotation of a straight-line beam about an axis to produce a circular pattern at a point where the laser beam impacts its target. Example lasers include ytterbium lasers, erbium lasers, neodymium lasers, dysprosium lasers, praseodymium lasers, and thulium lasers.

Figure 3:
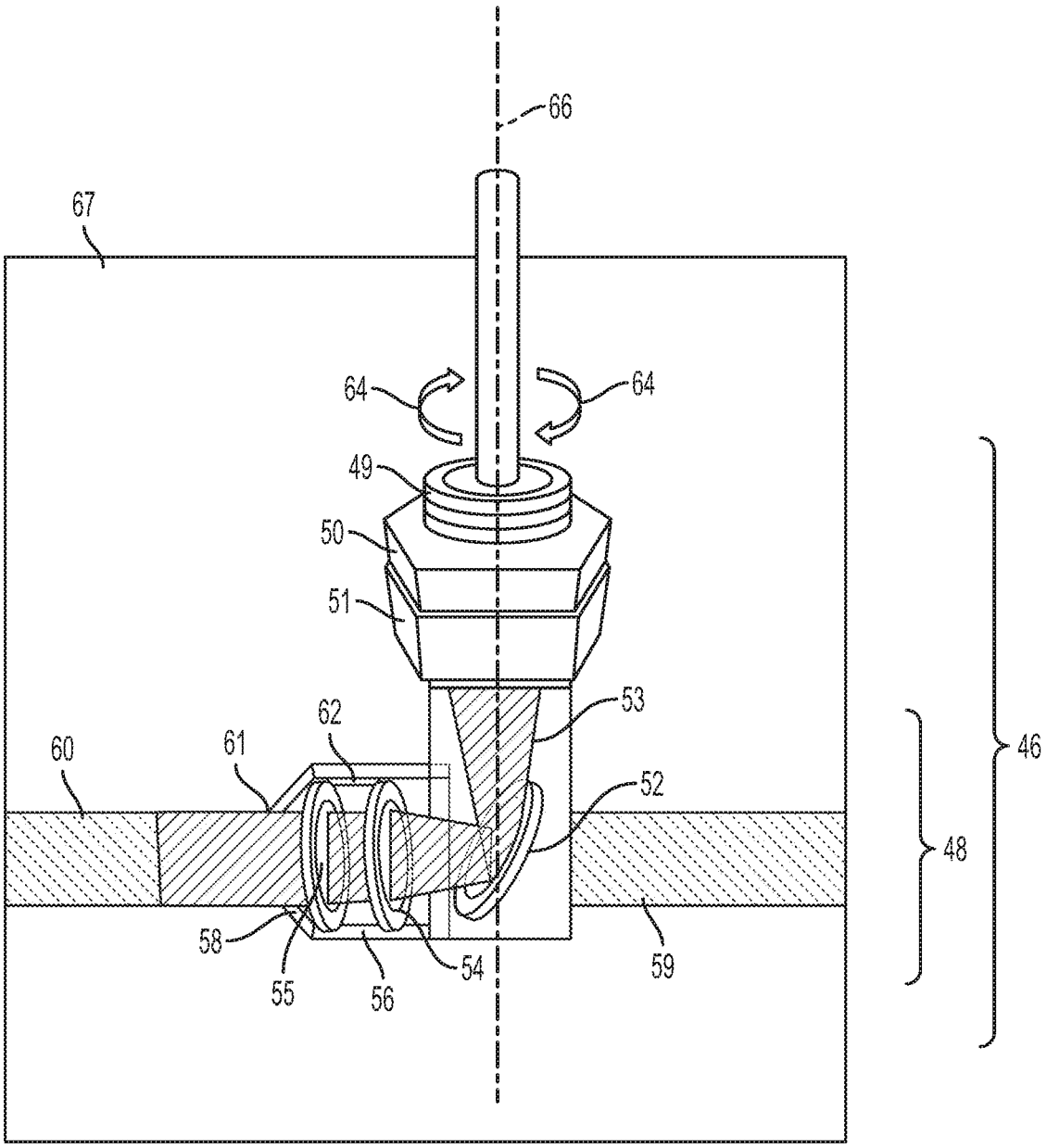
FIG. 3 is a cross-sectional side view of components of an example laser tool downhole in a wellbore.

Laser tool 18 also includes a head 21 to output a laser beam produced by the generator. Head 21 may be fixed to the generator or moveable relative to the generator. In some implementations, both the generator and the head may be configured for rotational movement, translational movement, or both rotational and translational movement within the wellbore. In some implementations, the generator may not rotate; instead, the head may be configured for rotation relative to the generator. In some implementations, rotation may be around a longitudinal axis 66 of the wellbore as shown in FIG. 3. In some implementations, rotation may include precession about the longitudinal axis 22 of the wellbore as shown in FIG. 1.

Optics may be located at the output of head 21. In some implementations, the optics may size the laser beam, shape the beam, or both size and shape the beam. Examples of optics include mirrors to direct the beam and lenses to size or to shape the beam. In the example of FIG. 1, however, there are no optics between the head and a target of the beam within the wellbore.

Laser tool 18 may include one or more purging knives. Purging knife 24 is configured to clear a path to the laser beam's target 25 by discharging a purging medium on or near head 21. In some implementations, the purging knife is configured to rotate along with the laser head or generator. Rotation is shown graphically in FIG. 1 by arrows 26. The choice of purging media to use, such as liquid or gas, can be based on the type or rock in the formation and the pressure of a reservoir associated with the formation. In some implementations, the purging media can be or include a non-reactive, non-damaging gas such as nitrogen or halocarbon. A halocarbon includes a compound, such as a chlorofluorocarbon, that incudes carbon combined with one or more halogens. Examples of halocarbon include halocarbon-oil having viscosities in a range from halocarbon-oil 0.8 centipoise (cP) to halocarbon-oil 1000 cP at 100 degrees) (° Fahrenheit (37.8° Celsius). A gas purging medium may be appropriate when fluid pressure in the wellbore is reduced, for example, less than 50000 kilopascals, less than 25000 kilopascals, less than 10000 kilopascals, less than 5000 kilopascals, less than 2500 kilopascals, less than 1000 kilopascals, or less than 500 kilopascals. In some implementations, purging may be cyclical. For example, purging may occur only while the laser beam is on.

Laser tool assembly 14 also includes a control system 28. In this example, control system 28 is configured to control movement of all or part of the laser tool to cause the laser beam to move within the wellbore. The control system can include, for example, a hydraulic system, an electrical system, or a motor-operated system to move the laser tool. For example, the control system may include a motor or other mechanical mechanism to cause the head, the generator, or both the head and the generator to rotate so that an output laser beam produces a circular pattern 30 at or near the bottom of wellbore 11. In an example, the output laser beam precesses about axis 22 to form circular pattern 30 at its point of impact at the bottom of wellbore 11.

Laser tool assembly 14 also includes cabling 17 that runs uphole to the surface of the wellbore. In an example, the cabling may include power cables to run electrical power to the generator. The electrical power may be generated uphole in some implementations. In an example, the cabling may include communication cables such as Ethernet or other wiring to carry commands to and from the laser tool.

The commands may be generated by a computing system 32 that is located at the surface. The commands may control operation of the laser tool. For example, the commands may include commands to turn the laser generator on or off, to adjust an intensity of the laser beam, or to control movement of the laser beam within the wellbore. In some implementations, all or some of these commands may be conveyed wirelessly. Dashed arrow 33 represents communications between the laser tool and the computing system. A casing 16 may also be part of the laser tool assembly. The casing may be made of metal or ceramic and may protect all or part of the cabling from downhole conditions.

The computing system may be configured—for example, programmed—to control positioning and operation of the laser tool. Examples of computing systems that may be used are described in this specification. Signals may be exchanged between the computing system and the control system via wired or wireless connections. In some implementations, signals may be exchanged between the computing system and the control system via fiber optic media. Alternatively, or in addition, the control system may include circuitry or an on-board computing system to implement control over the positioning and operation of the laser tool. The on-board computing system may also communicate with computing system 32.

In some implementations, the laser beam output by laser generator 20 has an energy density that is sufficient to heat at least some rock to its sublimation point. In this regard, the energy density of a laser beam is a function of the average power output of the laser generator during laser beam output. In some implementations, the average power output of laser generator 20 is in one or more of the following example ranges: greater than 1 kW, between 1 kW and 1.5 kW, between 1.5 kW and 2 kW, between 2 kW and 2.5 kW, between 2.5 kW and 3 kW, between 3 kW and 3.5 kW, between 3.5 kW and 4 kW, between 4 kW and 4.5 kW, between 4.5 kW and 5 kW, between 5 kW and 5.5 kW, between 5.5 kW and 6 kW, between 6 kW and 6.5 kW, or between 6.5 kW and 7 kW.

In some implementations, all or part of the laser tool assembly may be configured to withstand at least some environmental conditions within the wellbore. For example, all or part of the laser tool assembly may be made of materials that withstand environmental conditions within the wellbore, such as pressure within the wellbore, temperature within the wellbore, vibrations within the wellbore, debris within the wellbore, and fluid within the wellbore. The materials that make up components of the laser tool assembly may include one or more of the following: iron, nickel, chrome, manganese, molybdenum, niobium, cobalt, copper, titanium, silicon, carbon, sulfur, phosphorus, boron, tungsten, steel, steel alloys, stainless steel, or tungsten carbide.

In some implementations, the laser tool assembly may include one or more environmental or other sensors to monitor conditions downhole. The sensors may include one or more temperature sensors, one or more vibration sensors, one or more pressure sensors, or some combination of these or other sensors.

In an example implementation, laser tool 18 includes a temperature sensor configured to measure a temperate at its current location and to output signals representing that temperature. The signals may be output to the computing system located on the surface. In response to signals received from the temperature sensor, the computing system may control operation of the system. For example, if the signals indicate that the temperature downhole is great enough to cause damage to downhole equipment, the computing system may instruct that action be taken. For example, all or some downhole equipment, including the laser tool, may be extracted from the wellbore. In some implementations, data collected from the temperature sensor can be used to monitor the intensity of the laser beam. Such measurements may also be used to adjust the energy of the laser beam. For example, signals may be sent downhole wirelessly or via cabling to control operation of the laser generator. The signals may be based on commands generated by the computing system.

In some implementations, sensor signals may indicate a temperature that exceeds a set point that has been established for the laser tool or downhole equipment. For example, the set point may represent a maximum temperature that the laser tool can withstand without overheating. If the set point is reached, the laser tool may be shut-down. The value of the set point may vary based on type of laser being used or the materials used for the manufacture of the laser tool, for example. Examples of set points include 1000° Celsius (C), 1200° C., 1400° C., 1600° C., 1800° C., 2000° C., 2500° C., 3000° C., 3500° C., 4000° C., 4500° C., 5000° C., 5500° C., and 6000° C. In an example implementation, the set point is between 1425° C. and 1450° C.

Pressure and vibration sensors, for example, may also output sensor readings that affect operation of the system, such as changes to the energy of the laser beam or shutting-down operation of the system.

Figure 2:
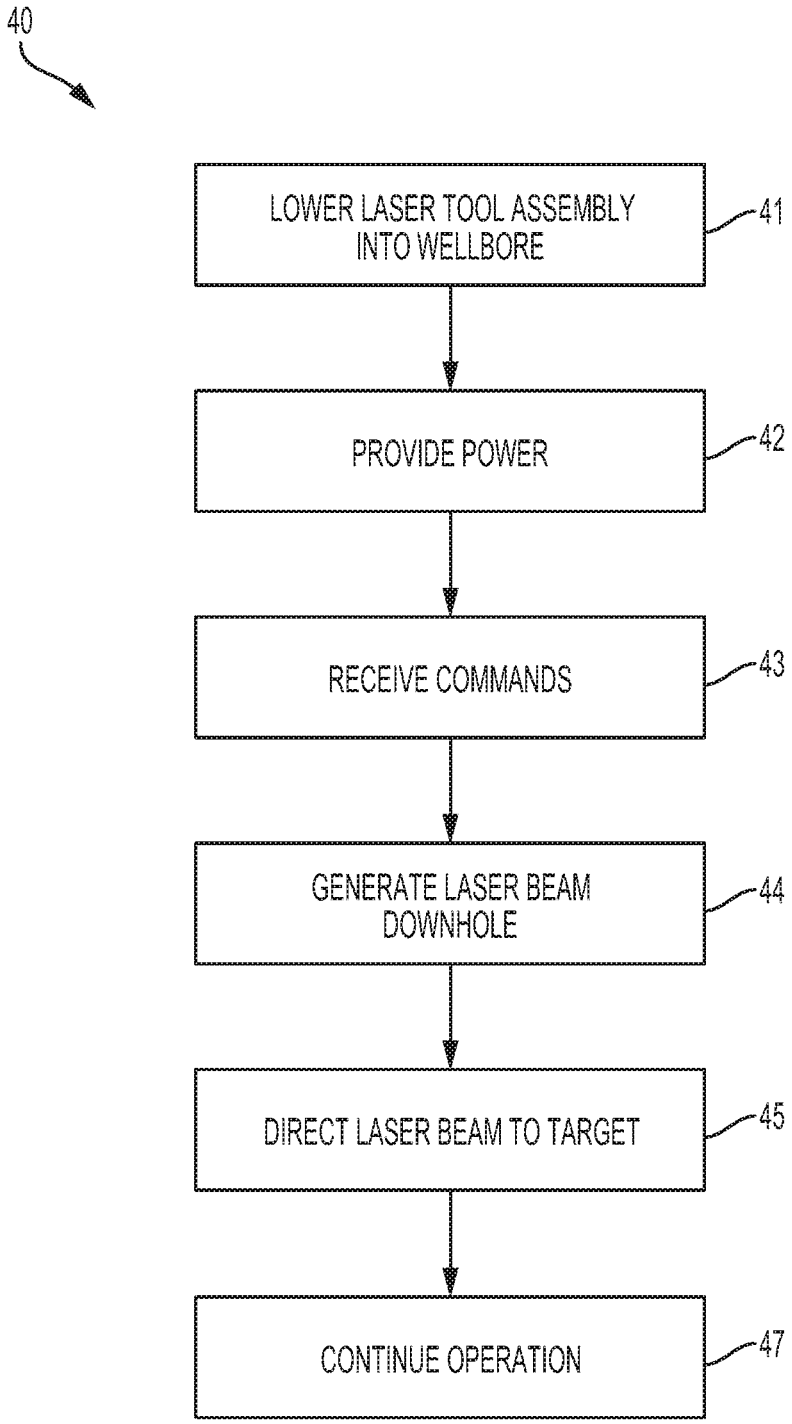
FIG. 2 is a flowchart showing operation of the example laser tool.

Referring to FIG. 2, in an example operation 40, laser tool assembly 14 including the laser generator is lowered (41) downhole in a wellbore. As described, the laser tool assembly may be lowered from the surface using coiled tubing or a wireline. Power to operate the laser generator may be provided (42) from a power source at the surface. As explained, power may be provided via cabling 17. Commands may be sent downhole and received (43) by the laser generator. As explained, the commands may be output by the computing system and may instruct the operation and configuration of the laser tool. For example, the commands may specify motion of the laser tool, positioning of the laser tool, or the optical power of the laser beam. In response to the commands, the laser generator generates (44) a laser beam downhole. In some implementations, the laser beam has an optical power of at least one kilowatt (1 kW). The laser beam is directed (45) to a target, such as an inner surface of the wellbore, to cut through at least part of a structure from within the wellbore. For example, the structure may include rock within the wellbore, a metal pipe or casing within the wellbore, or debris within the wellbore. In this context, cutting through the structure may include sublimating all or part of the structure. In the example of FIG. 1, the head is rotated about a pivot point to produce a circular pattern at a bottom of the wellbore. For example, the pivot point may be near the intersection of the wellbore's longitudinal axis and the head that outputs the laser beam. Operation may continue (47) until the laser tool is instructed to stop or until downhole conditions require operation to stop.

FIG. 3 shows an example laser tool 46 that includes an optical assembly 48. The other components of example laser tool 18 shown in FIG. 3 include control system 49, generator 50, and head 51. These components may have similar structures and functions as corresponding components of FIG. 1. Components of FIG. 1 not shown in FIG. 3, such as cabling 17 and casing 16, may also be used with laser tool 46. Like laser tool 18, laser tool 46 may receive electrical power from the surface and may receive control commands from a computing device at the surface.

In example laser tool 46, generator 50 is a direct diode laser that generates laser beams downhole that have various beam shapes. In this example, a converging laser beam 53 generated by generator 50 has an optical power ranging from 4 kW to 10 kW. Optical assembly 48 is configured to receive the laser beam from within the wellbore and to output the laser beam towards a rock formation or other target. In this example, optical assembly 48 includes a reflector 52, which may be a mirror, to receive a laser beam from head 51 and to direct the laser beam at an angle and towards other optics in the optical assembly. In this example, the other optics includes an optical control lens 54 and a cover lens 55. The optical control lens is configured—for example, shaped, arranged, or both shaped and arranged—to change the shape of the laser beam. For example, the optical control lens may focus the laser beam, collimate the laser beam, or spread the laser beam. Cover lens 55 protects the optical control lens, the reflector, and any other optics that may be present with housing 56. The cover lens need not affect the size or shape of the laser beam.

A purging knife 58 is configured to clear a path to the laser beam's target 60 by discharging a purging medium at or near the output 61 of the laser tool. The choice of purging media to use, such as liquid or gas, can be based on the type or rock in the formation and the pressure of a reservoir associated with the formation. In some implementations, the purging media can be, or include, a non-reactive, non-damaging gas such as halocarbon. A purging nozzle 62 is configured to expel dust or vapor from inside the optical assembly. In some implementations, purging nozzle 62 is within housing 56 and is configured to discharge a fluid or a gas onto or across surfaces of the lenses within the optical assembly. Examples of gas that may be used include air and nitrogen. In some implementations, the combined operation of purging knife 58 and purging nozzle 62 create an unobstructed path for transmission of the laser beam from the optical assembly to target 60, such as a rock formation or casing surface.

Control system 49 is configured to rotate the laser tool within the wellbore. Rotation is depicted by arrows 64. For example, the rotation may be around a longitudinal axis 66 of the wellbore 67. This rotation during output of the laser beam downhole may be used to ablate an inner circumference 59 of a target 60. For example, the rotation during output of the laser beam downhole may be used to ablate the inner surface of the wellbore or the inner surface of a casing. The rate of rotation, the extent of rotation, and the number of rotations may be controlled through commands received from the computing system at the surface or through preprogrammed commands stored in computer memory within the control system.

In operation, laser generator 50 generates a straight-line laser beam 53 that is output by head 51. In the example of FIG. 3, the straight-line laser beam travels vertically to reflector 52. Reflector 52 directs the straight-line laser beam towards optical control lens 54. Optical control lens 54 may change the size, shape, or both the size and the shape of the laser beam. The size and shape may be based on the operation that the laser tool is to perform, such as perforating a casing, heating the wellbore, or sublimating rock. Cover lens 55 protects the optics within the optical assembly, as described. For example, the cover lens may prevent debris or particles from adversely affecting the optics. Purging nozzle 62 and purging knife 58 may also be operated to protect the optics, to cool the optics, to clear the beam path, and to cool the target of the laser beam. To this end, purging media is output in the same direction as the laser beam. The laser tool may be controlled to rotate within the wellbore to apply the laser beam to the inner circumference 59 of target 60, as shown in FIG. 3.

Figure 4:
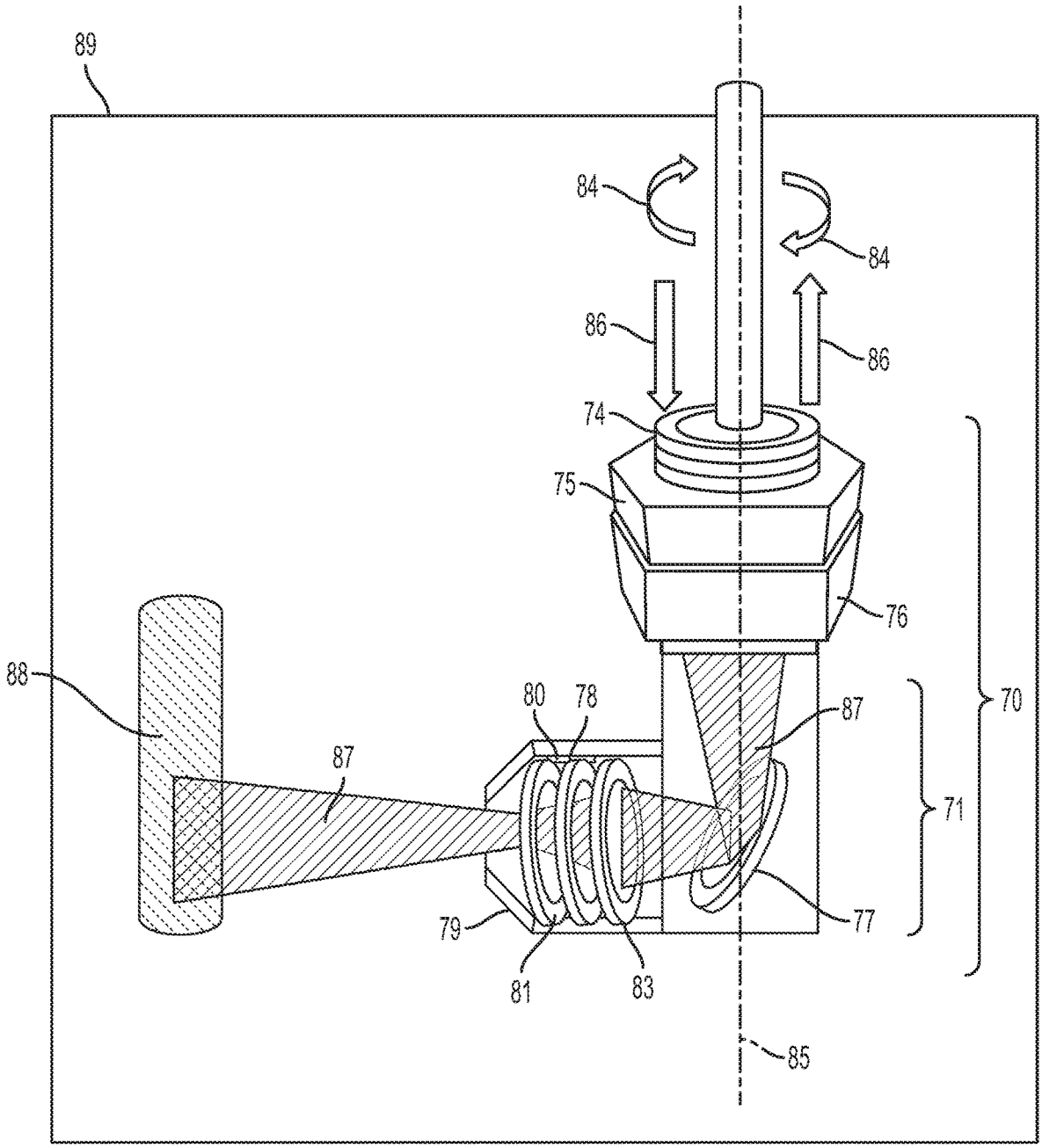
FIG. 4 is a cross-sectional side view of components of an example laser tool downhole in a wellbore.

FIG. 4 shows an example laser tool 70 that includes an optical assembly 71. The other components of example laser tool 70 shown in FIG. 4 include control system 74, generator 75, head 76, reflector 77, optical control lens 78, purging knife 79, purging nozzle 80, and cover lens 81. These components may have similar structures and functions as corresponding components of FIGS. 1 and 3. Components of FIG. 1 that are not shown in FIG. 4, such as cabling and casing, may also be used with laser tool 70. Like laser tools 18 and 46, laser tool 70 may receive electrical power from the surface and may receive control commands from a computing device at the surface.

In this implementation, optical assembly 71 includes an optical orientation lens 83. The optical orientation lens is the first lens in the beam path in this example. Accordingly, the optical orientation lens is the first lens that the laser beam 87 encounters while exiting the laser tool. The optical orientation lens changes an orientation of the laser beam from a vertical orientation to a horizontal orientation. For example, the polarization of the laser beam may be changed by 90°.

In this example, laser tool 70, including the optical assembly, is rotatable around the longitudinal axis 85 of the wellbore as described previously. Rotation is shown conceptually by arrows 84. Laser tool 70 is also configured for translational motion along a longitudinal axis 85 of the wellbore. Translational motion is shown conceptually by arrows 86. For example, control system 74 is configured to move the laser tool, including the optical assembly, along longitudinal axis 85 of the wellbore. To implement such movement, the entire laser tool assembly may be configured to move along or with the coiled tubing. This translational motion along the longitudinal axis of the wellbore—which is vertical movement in some cases—may be implemented to apply laser beam 87 to a vertical strip 88 of a target 89 such as an inner surface of a wellbore or a casing. In some implementations, the laser tool may also be rotated around the longitudinal axis 85 during the translational movement. This combination of rotational and translational movement may be used to treat different parts of the target.

The example laser tools described in this specification may be operated in wells that are vertical or in wells that are, in whole or part, non-vertical. For example, the laser tools may be operated in a deviated well, a horizontal well, or a partially horizontal well, where horizontal is measured relative to the Earth's surface.

The example laser tools may operate downhole to stimulate a wellbore. For example, the laser tools may operate downhole to create a fluid flow path through a rock formation. The fluid flow path may be created by controlling the laser tool to direct a laser beam towards the rock formation. In an example, the laser beam has an energy density that is great enough to cause at least some of the rock in the rock formation to sublimate. Sublimation includes changing from a solid phase directly into a gaseous phase without first changing into a liquid phase. In this example, the sublimation of the rock creates tunnels or cracks through the rock formation. Fluids, such as water, may be introduced into those tunnels or cracks to fracture the rock formation and thereby promote the flow of production fluid, such as oil, from the rock formation into the wellbore. In some cases, heat from the laser beam alone may generate cracks in a formation through which hydrocarbons may flow. Accordingly, stimulation may be achieved without the use of hydraulic fracturing fluids, such as water.

The example laser tools may operate downhole to create openings in a casing in the wellbore to repair cementing defects. In an example, a wellbore includes a casing that is cemented in place to reinforce the wellbore against a rock formation. During cementing, cement slurry is injected between the casing and the rock formation. Defects may occur in the cement layer, which may require remedial cementing. Remedial cementing may involve squeezing additional cement slurry into the space between the casing and the rock formation. The example laser tools may be used to direct a laser beam to the casing to create one or more openings in the casing on or near a cementing defect. The openings may provide access for a cementing tool to squeeze cement slurry through the opening into the defect.

The example laser tools may operate downhole to create openings in a casing in the wellbore to provide access for a wellbore drilling tool. In an example, an existing single wellbore is converted to a multilateral well. A multilateral well is a single well having one or more wellbore branches extending from a main borehole. In order to drill a lateral well into a rock formation from an existing wellbore, an opening is created in the casing of the existing wellbore. The example laser tools may be used to create the opening in the casing at a desired location for a wellbore branching point. The opening may provide access for drilling equipment to drill the lateral wellbore.

The example laser tools may operate downhole to create openings in a casing in the wellbore to provide sand control. During operation of a well, sand or other particles may enter the wellbore causing a reduction in production rates or damage to downhole equipment. The example laser tools may be used to create a sand screen in the casing. For example, the laser tools may be used to perforate the casing by creating a number of holes in the casing that are small enough to prevent or to reduce entry of sand or other particles into the wellbore while maintaining flow of production fluid into the wellbore.

The example laser tools may operate downhole to re-open a blocked fluid flow path. In this regard, production fluid flows from tunnels or cracks in the rock formation into the wellbore through holes in the wellbore casing and cement layer. These production fluid flow paths may become clogged with debris contained in the production fluid. The example laser tools may be used to generate a laser beam that has an energy density that is great enough to liquefy or to sublimate the debris in the flow paths, allowing for removal of the debris together with production fluid. For example, a laser tool may be used to liquefy or to sublimate sand or other particles that may have become packed tightly around a sand screen in the casing, thereby re-opening a production fluid flow path into the wellbore.

The example laser tools may operate downhole to weld a wellbore casing or other component of a wellbore. During operation, one or more metal components of a wellbore may become rusted, scaled, corroded, eroded, or otherwise defective. Such defects may be repaired using welding techniques. The laser tools may be used to generate a laser beam that has an energy density that is great enough to liquefy metal or other material to create a weld. In some implementations, material of a wellbore component, such as a casing material, may be melted using the laser tool. Resulting molten material may flow over or into a defect, for example due to gravity, thus covering or repairing the defect upon cooling and hardening. In some implementations, a laser tool may be used in combination with a tool that provides filler material to the defect. The laser tool may be used to melt an amount of filler material positioned on or near a defect. The molten filler material may flow over or into a defect, thus covering or repairing the defect upon cooling and hardening.

The example laser tools may operate downhole to heat solid or semi-solid deposits in a wellbore. In producing wells, solid or semi-solid substances may deposit on wellbore walls or on downhole equipment causing reduced flow or blockages in the wellbore or production equipment. Deposits may be or include condensates (solidified hydrocarbons), asphaltene (a solid or semi-solid substance comprised primarily of carbon, hydrogen, nitrogen, oxygen, and sulfur), tar, hydrates (hydrocarbon molecules trapped in ice), waxes, scale (precipitate caused by chemical reactions, for example calcium carbonate scale), or sand. The example laser tools may be used to generate a laser beam that has an energy density that is great enough to melt or to reduce the viscosity of deposits. The liquefied deposits can be removed together with production fluid or other fluid present in the wellbore.

In some implementations, the laser tool as a maximum lateral diameter of less than 5.5 inches (about 14 centimeters), allowing the laser tool to fit within downhole pipes or other structures having a minimum diameter of 5.5 inches.

At least part of the example laser tools and their various modifications may be controlled by a computer program product, such as a computer program tangibly embodied in one or more information formation carriers. Information carriers include one or more tangible machine-readable storage media. The computer program product may be executed by a data processing apparatus. A data processing apparatus can be a programmable processor, a computer, or multiple computers.

A computer program may be written in any form of programming language, including compiled or interpreted languages. It may be deployed in any form, including as a stand-alone program or as a module, component, subroutine, or other unit suitable for use in a computing environment. A computer program may be deployed to be executed on one computer or on multiple computers. The one computer or multiple computers can be at one site or distributed across multiple sites and interconnected by a network.

Actions associated with implementing the systems may be performed by one or more programmable processors executing one or more computer programs. All or part of the systems may be implemented as special purpose logic circuitry, for example, an field programmable gate array (FPGA) or an ASIC application-specific integrated circuit (ASIC), or both.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the systems described without adversely affecting their operation or the operation of the system in general. Furthermore, various separate elements may be combined into one or more individual elements to perform the functions described in this specification.

Other implementations not specifically described in this specification are also within the scope of the following claims.

What is claimed:

1. A laser tool configured to operate within a wellbore, the laser tool comprising:

a generator to generate a laser beam, the generator being configured to fit within the wellbore, to withstand at least some environmental conditions within the wellbore, and to generate the laser beam from within the wellbore, the laser beam having an optical power from one kilowatt (1 kW) to ten kilowatts (10 kW);

an optical assembly fitting within the wellbore, where the optical assembly comprises:

a reflector to change a direction of the laser beam: and one or more lenses to shape the laser beam prior to output;

a housing holding the optical assembly, the housing comprising a purging nozzle and a purging knife that are configured to cool the optical assembly and to clear a path for the laser beam to a target; and a control system to control movement of at least part of the laser tool to cause the laser beam to move within the wellbore, where the optical assembly receives the laser beam from within the wellbore, and outputs the laser beam towards the target, where the purging knife is inclined at an angle relative to the laser beam, the purging knife being configured to output a purging media in a direction of the laser beam, where the purging media comprises a liquid, and where the purging media is output when the pressure within the wellbore has been reduced to 25,000 kilopascals or lower.

2. The laser tool of claim 1, where the generator comprises a head to output the laser beam, the control system being configured to rotate the head about a pivot point to produce a circular pattern downhole of the wellbore, and where components of the laser tool are composed of at least one of iron, nickel, chrome, manganese, molybdenum, and niobium.

3. The laser tool of claim 1, where the optical assembly is rotatable within the wellbore, and where rotation of the optical assembly is around a longitudinal axis of the wellbore.

4. The laser tool of claim 1, where the optical assembly is movable along a longitudinal axis of the wellbore.

5. The laser tool of claim 1, where shaping the laser beam comprises focusing the laser beam, and where components of the laser tool are composed of at least one of cobalt, copper, titanium, silicon, carbon, sulfur, and phosphorus.

6. The laser tool of claim 1, where shaping the laser beam comprises collimating the laser beam, and where components of the laser tool are composed of at least one of boron, tungsten, steel, steel alloys, stainless steel, and tungsten carbide.

7. The laser tool of claim 1, further comprising a maximum lateral diameter of less than five-and-a-half (5.5) inches, and where shaping the laser beam comprises spreading the laser beam.

8. The laser tool of claim 1, where the purging media comprises a halocarbon-oil comprising a viscosity from 0.8 centipoise (cP) to 1000 centipoise (cP) at 100 degrees Fahrenheit.

9. The laser tool of claim 1, where the one or more lenses comprises:

an optical control lens to control at least one of a size or a shape of the laser beam; and a cover lens to protect at least the optical control lens, where the optical control lens is disposed between the cover lens and the reflector.

10. The laser tool of claim 9, where the one or more lenses comprises an orientation lens to change an orientation of the laser beam between a vertical orientation and a horizontal orientation;

where the cover lens also protects the orientation lens, where the orientation lens is disposed between the optical control lens and the reflector, and where the cover lens is disposed between the optical control lens and the purging knife.

11. The laser tool of claim 1, where the at least some environmental conditions comprise a temperature within the wellbore, and where the temperature includes a range from 1000 degrees C. to 6000 degrees C.

12. The laser tool of claim 11, where the generator comprises a direct diode laser, and where the temperature includes a range from 1425 degrees C. to 1450 degrees C.

* * * * *